United States Patent [19]

Sturdevan et al.

[11] Patent Number: 4,797,115

[45] Date of Patent: Jan. 10, 1989

[54] ANGLED BOOT FOR ANGLED SPARK PLUG CABLE TERMINALS

[75] Inventors: Ronald P. Sturdevan, Tifton; Alexander J. Pickelhaupt, Valdosta, both of Ga.

[73] Assignee: Prestolite Wire Corporation, Farmington Hills, Mich.

[21] Appl. No.: 121,045

[22] Filed: Nov. 13, 1987

[51] Int. Cl.[4] ..... H01R 11/11; H01R 13/516

[52] U.S. Cl. ..... 439/125; 174/138 S; 439/476

[58] Field of Search ..... 174/77 S, 138 S, 31 S; 123/143 C, 169 P, 169 PA, 169 PH; 313/135; 439/125–128, 278, 279, 281–283, 587–589, 731, 476, 483

[56] References Cited

U.S. PATENT DOCUMENTS

| | | | |
|---|---|---|---|
| 2,550,358 | 4/1951 | Le Grand et al. | 439/125 |
| 2,904,769 | 9/1959 | Sampson et al. | 439/125 |
| 2,943,139 | 6/1960 | Skunda | 439/125 |
| 3,573,709 | 4/1971 | Elliott | 439/125 |
| 3,597,723 | 8/1971 | Schmidt et al. | 439/125 |

*Primary Examiner*—Gil Weidenfeld
*Assistant Examiner*—Gary F. Paumen
*Attorney, Agent, or Firm*—Remy J. VanOphem

[57] ABSTRACT

An elastomer angled boot for an angled spark plug cable terminal having an angular bend of between 90° and 180°. The angled boot has two protuberances, the first protuberance providing a pressing surface and the second protuberance providing a pulling surface. Each of the pressing and pulling surfaces is oriented in a plane perpendicular to the spark plug insertion axis, and serve as an aid during installation on, and removal from the spark plug. A concave notch is provided at the bend in the spark plug cable terminal which interlockingly co-operates with a convex knob on the angled boot to prevent relative slippage therebetween.

11 Claims, 1 Drawing Sheet

ANGLED BOOT FOR ANGLED SPARK PLUG CABLE TERMINALS

BACKGROUND OF THE INVENTION

1. Field of the Invention

This invention relates to boots which are intended to fit over the electrical connection between a spark plug and a spark plug cable. More particularly, this invention relates to an angled boot which is intended to fit over an angled spark plug cable terminal.

2. Description of the Prior Art

Elastomer boots are used to cover the connection between a spark plug and its associated spark plug cable. These boots serve as a dielectric and a moisture shield for the high voltages carried through the connection. In most applications, the spark plug cable terminal is structured to attach to the spark plug electrode in a direction coinciding with the axial attitude of the spark plug. Thus, in these common situations, the boot need only be structured to accommodate a 180° orientation between the spark plug and the spark plug cable terminal.

Modern gasoline engines are frequently situated in cramped engine compartments, resulting in a need to provide terminals having other than 180° configurations. Those situations utilizing 90° configurations in the spark plug cable terminal are covered by an elastomer boot of a similar shape. These 90° boots permit easy and assured installation of the spark plug cable terminal onto the spark plug electrode because the mechanic need only press down on the horizontal component on the boot to ensure proper seating of the spark plug cable terminal.

Situations involving other than 180° and 90° spark plug cable terminal configurations make the connection to the spark plug frequently very difficult. This is because the angle of the spark plug cable terminal is such as to preclude the mechanic from having any point on the boot surface which is above the connection point with the spark plug electrode. Accordingly, he can't press the boot directly downward onto the spark plug. Secondly, because these situations are frequently accommodated by the use of 180° boots, a poor and loose fit results which yields very poor dielectric and moisture barrier characteristics.

Several attempts have been made in the prior art to develop a boot for applications involving angles of the spark cable terminal at other than 180° or 90°.

U.S. Pat. No. 2,792,558 to Woofter is directed to solving the problem of assembling a boot over an acutely angled spark plug cable terminal. He solves this problem by providing a boot having an acute angle within which is a terminal having a head and circular portion angled to accept the spark plug when inserted into the boot.

U.S. Pat. No. 3,354,419 to Miller, Jr. is directed to the problem that prior art boots accommodate only 90° and 180° spark plug cable terminals. He solves this problem by providing a variable angle spark plug cable terminal and a two (2) component boot which is held together by a screw.

U.S. Pat. No. 3,867,001 to Hedman is directed to the problem of degradation of the spark plug coupling because of proximity to the exhaust manifold. He solves this problem by providing an adapter to move the spark plug cable connection to a laterally displaced location. The insulator boot has an angle other than 180° or 90°.

U.S. Pat. No. 4,413,870 to Labutski, III is directed to solving the problem that a spark plug cable of an engine must be individually sized and angled for each particular spark plug. He solves this problem by providing a position retaining mechanism between two wire clamps and covering these with a flexible boot having serrations to facilitate flexing.

None of the above cited patents solve the problem of providing a custom boot for spark plug cable terminals having an angle other than 180° or 90°, which further provides a structure that ensures proper seating of the spark plug during installation on a spark plug. Additionally, none of the cited patents has adequately addressed the problem of insulator slippage along the boot which can give a mechanic a false sensation of a properly seated spark plug cable terminal. Lastly, the above cited patents do not address the important issue of reasonable cost and high reliability.

Hence, there remains a problem in the art to devise a spark plug boot which specifically accommodates spark plug cable terminals having angles other than 180° or 90°, which has provision to assure seating of the spark plug cable terminal onto the spark plug electrode, as well as prevention of insulator slippage within the boot and, finally, which is inexpensive and very reliable.

SUMMARY OF THE INVENTION

The invention is an angled boot for an angled spark plug cable terminal. An angled boot is provided which is made of an elastomeric material. The angled boot has a first and second portion which are angled relative to each other. A central bore runs through the angled boot for receiving the angled spark plug cable terminal. An aperture of a first end of the angled boot is contiguous the central bore and is provided for receiving a spark plug. An aperture at a second end of the angled boot is contiguous the central bore and is provided for receiving a spark plug cable which is mechanically and electrically connected to the spark plug cable.

A first external protuberance is provided on the second portion of the angled boot. The first external protuberance has a pressing surface which is in a plane substantially perpendicular to the axis of the central bore of the first portion of the angled boot. Provision is made for the angled boot to be fixedly retained relative to the spark plug cable terminal.

Accordingly, it is an object of the invention to provide an angled boot which accommodates an angled spark plug cable terminal having an angle other than 180° or 90°.

It is a further object of the invention to provide an angled boot which provides an interfering relationship between an angled spark plug cable terminal and the angled boot, thus, preventing slippage of the spark plug cable within the angled boot.

It is yet a further object of the invention to provide an angled boot for an angled spark plug cable terminal which has a pressing surface that is perpendicular to the axis of the central bore of the angled boot which receives the spark plug.

It is still a further object of the invention to provide an angled boot for an angled spark plug cable terminal which has a pulling surface that is perpendicular to the axis of the central bore of the angled boot which receives the spark plug.

These and other objects, advantages, features and benefits of the invention will become apparent from the following specification.

DETAILED DESCRIPTION OF THE PREFERRED EMBODIMENT

Figure 1:
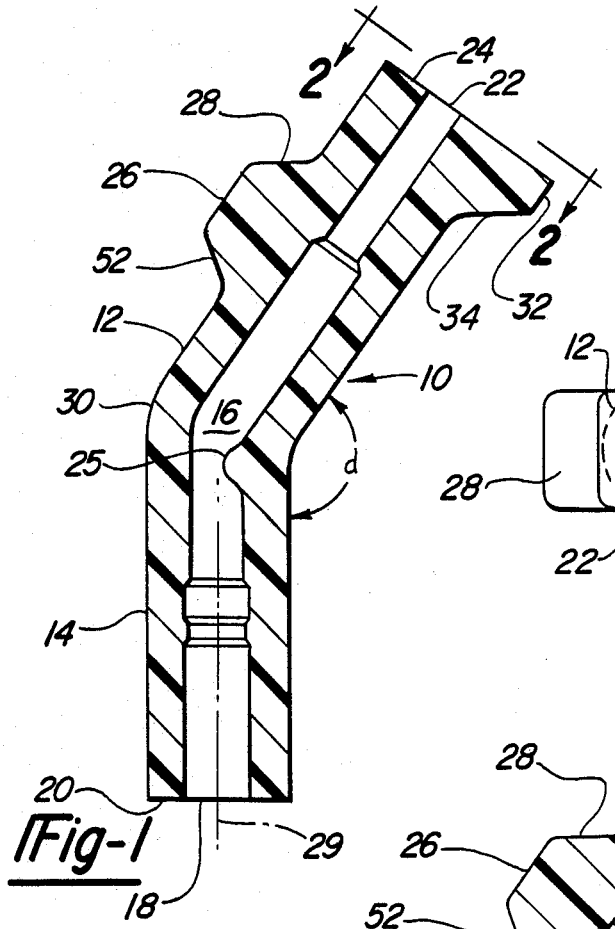
FIG. 1 is a cross-sectional side view of the invention.
Figure 2:
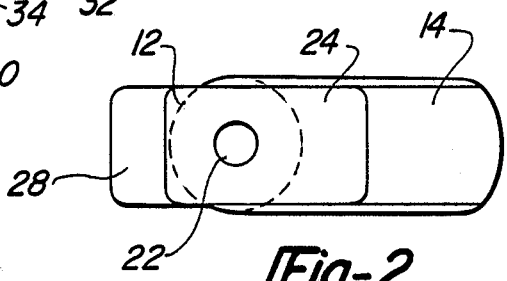
FIG. 2 is a plan view of the invention along lines 2—2 in FIG. 1.

Referring now to the figures, FIG. 1 shows the invention 10 which is an angled boot for covering a spark plug, a spark plug cable and, importantly, an angled spark plug cable terminal. The angled boot 10 is of a single piece construction, having an upper portion 12 and a lower portion 14. The upper portion 12 is angled in relation to the lower portion 14 by an angle of between 180° and 90°; FIG. 1 shows this angle to be equal to 145°. The boot is made from any of the materials commonly used in the manufacture of elastomer spark plug boots; a preferred material is silicone rubber. Each of the upper and lower portions 12 and 14 of the angled boot are generally of cylindrical shape as can be seen in FIG. 2.

A central bore 16 extends through the center of the angled boot 10. The central bore has two differently sized apertures. A first aperture 18 at a lowermost end 20 of the lower portion 14 is structured to accommodate entry of a spark plug. A second aperture 22 at an uppemost end 24 of the upper portion 12 is structured to accommodate entry of a spark plug cable. Near a bend 30 between the upper and lower portions and just on the side of the lower portion 14 a convex shaped knob 25 is provided within the central bore 16.

A first external protuberance 26 is integral with the upper portion between its uppermost end 24 and the bend 30. The first external protuberance 26 includes a pressing surface 28 which is oriented in a plane perpendicular to the axis 29 of the central bore 16 in the lower portion 14. The position of the first external protuberance 26 on the angled boot is selected so that the pressing surface 28 is located substantially above the lower portion 14 along the axis 29. This position of the first external protuberance will cause any force applied to the pressing surface 28 to be directed along the axis 29. A second external protuberance 32 is integral with the upper portion 12. It is adjacent the uppermost end 24 and opposite the first external protuberance 26. The second external protuberance 32 includes a pulling surface 34 which is oriented in a plane perpendicular to the axis 29.

Figure 3:
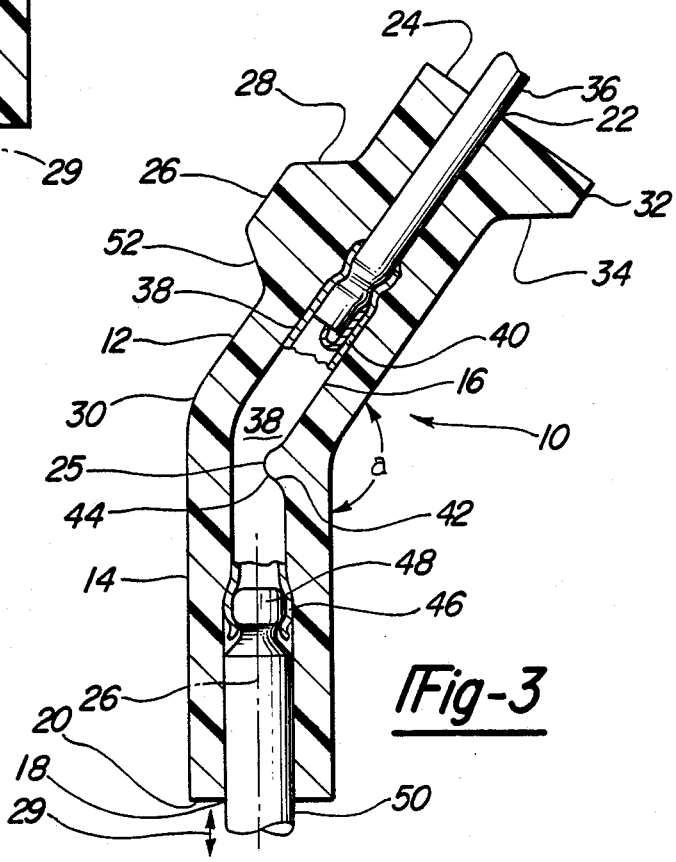
FIG. 3 is a partial cross-sectional side view showing the invention in operation.

FIG. 3 shows the invention in operation. The angled boot 10 is formed around a portion of a spark plug cable 36, as well as a spark plug cable terminal 38, which is mechanically and electrically connected in a well known manner to a wire 40 of the spark plug cable 36. A concave notch 42 on the spark plug cable terminal 38 interlockingly cooperates with the convex shaped knob 25 on an internal surface 44 of the boot 10. The spark plug cable terminal 38 has an electrical connector 46 which is structured to mate with an electrode 48 of a spark plug 50. As can be seen with reference to FIG. 3, the electrode 48 of the spark plug 50 enters through the first aperture 18. It should be noted that friction or adhesion between the angled boot and the spark plug cable and its associated terminal may, alternatively, suffice to keep the components in fixed relationship to each other.

Operation of the invention will now be described. A mechanic takes hold of the angled boot and generally aligns the first aperture 18 of angled boot above the spark plug 50. By pressing on the pressing surface 28 in conjunction with the pulling surface 34, the mechanic can deliver, effortlessly and assuredly, sufficient force to seat the angled boot and its associated spark plug cable terminal onto the spark plug. It is to be noted that the seating force applied by the mechanic, by virtue of the pressing and pulling surfaces, is in a direction parallel to the axis 29 of the central bore 16. Because the seating force is parallel to this axis, the angled boot will slide over the spark plug without any binding, distortion or undue friction. Further, because of the interlocking relationship between the concave notch 42 and the convex knob 25, there is no possibility of the angled boot sliding along the spark plug cable terminal during installation or removal, relative to the spark plug. Removal of the angled boot is easily accomplished by grabbing the pulling surface 34 and, if preferred, the lower surface 52 on the first external protuberance 26, and then pulling away from the spark plug.

To those skilled in the art to which this invention appertains, the above described preferred embodiment may be subject to change or modification. Such changes or modifications can be carried out without departing from the scope of the invention, which is intended to be limited only by the scope of the appended claims.

What is claimed is:

1. An angled boot for an angled spark plug cable terminal, comprising:

an angled boot made from an elastomeric material having a first portion with a first end and a second portion with a second end, said portions being disposed at an angle relative to each other, said angle being greater than 90° and less than 180°, each of said first and second portions having a central bore for receiving said angled spark plug cable terminal, said angled boot having at said first end a first aperture contiguous with said central bore for receiving a spark plug and at said second end a second aperture contiguous with said central bore for receiving a spark plug cable which is mechanically and electrically connected to said spark plug cable terminal;

a first external protuberance provided on said second portion of said angled boot, said first external protuberance having a pressing surface which is in a plane substantially perpendicular to the axis of said central bore of said first portion of said angled boot for pressing said terminal onto a spark plug; and retaining means for fixedly retaining said angled boot and said spark plug cable terminal relative to each other.

2. The angled boot of claim 1, further comprising a second external protuberance provided on said second portion of said angled boot, said second external protuberance having a pulling surface which is in a plane substantially perpendicular to the axis of said central bore of said first portion of said angled boot.

3. The angled boot of claim 2, wherein said angled spark plug cable terminal has a concave notch and said angled boot has a convex knob; said retaining means comprising said convex knob being received by said concave notch to provide an interlocking relationship therebetween.

4. The angled boot of claim 3, wherein said angle is substantially 145°.

5. An angled boot for an angled spark plug cable terminal, comprising:

an angled boot made from an elastomeric material having a first portion with a first end and a second portion with a second end, said portions being disposed at an angle relative to each other, said angle being greater than 90° and less than 180°, each of said first and second portions having a central bore for receiving said angled spark plug cable terminal in said central bore, said angled boot having at said first end a first aperture contiguous with said central bore for receiving a spark plug and at said second end a second aperture contiguous with said central bore for receiving a spark plug cable which is mechanically and electrically connected to said spark plug cable terminal;

a first external protuberance positioned at a predetermined location on one side of said second portion of said angled boot, said first external protuberance having a pressing surface which is in a plane substantially perpendicular to the axis of said central bore of said first portion of said angled boot for pressing said terminal onto a spark plug;

a second external protuberance positioned substantially on the other side of said second portion of said angled boot from said first external protuberance, said second external protuberance having a pulling surface which is substantially in a plane perpendicular to said axis for pulling said terminal from a spark plug; and retaining means for fixedly retaining said angled boot and said spark plug cable terminal relative to each other.

6. The angled boot of claim 5, wherein said angled spark plug cable terminal has a concave notch and said angled boot has a convex knob; said retaining means comprising said convex knob being received by said concave notch to provide an interlocking relationship therebetween.

7. The angled boot of claim 6, wherein said angle is substantially 145°.

8. a spark plug cable connection system, comprising:

an angled spark plug cable terminal having at one end a spark plug electrical connector;

an angled boot made of an elastomeric material having a first portion with a first end and a second portion with a second end, said portions being disposed at an angle relative to each other, said angle being greater than 90° and less than 180°, said first and second portions having a central bore receiving said angled spark plug cable terminal the central bore in said second portion receiving a portion of said spark plug cable, said angled boot having at said first end a first aperture contiguous with said central bore for receiving a spark plug, said angled boot further having at said second end a second aperture contiguous with said central bore for receiving said spark plug cable, said spark plug electrical connector making electrical contact with said spark plug when said spark plug is received by said first aperture of said first portion of said angled boot;

a first external protuberance positioned at a predetermined location on said second portion of said angled boot, said first external protuberance having a pressing surface which is in a plane substantially perpendicular to an axis defined by the axis of said central bore of said first portion of said angled boot for pressing said terminal onto a spark plug; and retaining means for fixedly retaining said angled boot and said spark plug cable terminal relative to each other.

9. The angled boot of claim 8, further comprising a second external protuberance on said angled boot located substantially on the other side of said second portion of said angled boot from said first external protuberance, said second external protuberance having a pulling surface which is in a plane substantially perpendicular to said axis.

10. The angled boot of claim 9, wherein said angled spark plug cable terminal has a concave notch and said angled boot has a convex knob, said retaining means comprising said convex knob being received by said concave notch to provide an interlocking relationship therebetween.

11. The angled boot of claim 10, wherein said second portion of said angled boot is angled relative to said first portion of said angled boot by an angle of substantially 145°.

* * * * *

UNITED STATES PATENT AND TRADEMARK OFFICE

CERTIFICATE OF CORRECTION

PATENT NO. : 4,797,115

DATED : January 10, 1989

INVENTOR(S) : Ronald P. Sturdevan and Alexander J. Picklehaupt

It is certified that error appears in the above-identified patent and that said Letters Patent is hereby corrected as shown below:

Column 3, line 33, delete "pemost" and insert ---- permost ----.

Column 6, line 9, after "terminal" insert a comma ---- , ----.

Signed and Sealed this

Nineteenth Day of September, 1989

*Attest:*

DONALD J. QUIGG

*Attesting Officer*

*Commissioner of Patents and Trademarks*